US009109798B2

(12) United States Patent
Lovato et al.

(10) Patent No.: US 9,109,798 B2
(45) Date of Patent: Aug. 18, 2015

(54) PREMIX BURNER

(75) Inventors: Andrea Lovato, Terranegra Legnago (IT); Vito Poletto, Bovolone (IT)

(73) Assignee: RIELLO S.p.A. (IT)

( * ) Notice: Subject to any disclaimer, the term of this patent is extended or adjusted under 35 U.S.C. 154(b) by 623 days.

(21) Appl. No.: 13/474,880

(22) Filed: May 18, 2012

(65) Prior Publication Data

US 2012/0295207 A1 Nov. 22, 2012

(30) Foreign Application Priority Data

May 18, 2011 (IT) ..... BO2011A0281

(51) Int. Cl.

| | |
|---|---|
| ***F23D 14/14*** | (2006.01) |
| ***F23D 23/00*** | (2006.01) |
| ***F23D 14/02*** | (2006.01) |
| ***F23D 14/26*** | (2006.01) |
| ***F23Q 3/00*** | (2006.01) |
| ***F23Q 9/04*** | (2006.01) |

(52) U.S. Cl.

CPC ..... *F23D 23/00* (2013.01); *F23D 14/02* (2013.01); *F23D 14/26* (2013.01); *F23Q 3/008* (2013.01); *F23Q 9/045* (2013.01)

(58) Field of Classification Search

CPC ..... F23C 2700/043; F23D 14/02; F23D 2203/005; F23D 2203/1012; F23D 2207/00; F23D 14/12; F23D 14/14; F23D 14/145; F23D 14/26; F23Q 9/045

USPC ..... 431/326–329, 353; 126/91 A

See application file for complete search history.

(56) References Cited

U.S. PATENT DOCUMENTS

| | | | | | |
|---|---|---|---|---|---|
| 2,284,568 | A | * | 5/1942 | Garber | 431/196 |
| 2,579,370 | A | * | 12/1951 | Donley | 431/339 |
| 2,663,362 | A | * | 12/1953 | Ransome | 431/238 |
| 2,980,104 | A | * | 4/1961 | Patrick et al. | 126/271.2 R |
| 3,122,195 | A | * | 2/1964 | Kimmel et al. | 431/80 |
| 3,349,752 | A | * | 10/1967 | Murphy | 119/307 |
| 3,645,511 | A | * | 2/1972 | Alms et al. | 431/283 |
| 3,692,016 | A | * | 9/1972 | Stikkers et al. | 126/271.2 B |
| 3,733,170 | A | * | 5/1973 | Kobayashi et al. | 431/329 |
| 4,128,393 | A | * | 12/1978 | Sneed | 431/351 |
| 4,311,452 | A | * | 1/1982 | Begin | 431/352 |
| 5,165,887 | A | * | 11/1992 | Ahmady | 431/329 |
| 5,520,536 | A | * | 5/1996 | Rodgers et al. | 431/329 |

(Continued)

FOREIGN PATENT DOCUMENTS

| | | |
|---|---|---|
| EP | 1083386 | 3/2001 |
| GB | 2072317 | 9/1981 |

(Continued)

OTHER PUBLICATIONS

Italian Search Report mailed Dec. 31, 2011 in Italian Appln. No. IT BO2011 0281.

*Primary Examiner* — Jorge Pereiro

(74) *Attorney, Agent, or Firm* — Davidson Berquist Jackson & Gowdey LLC

(57) ABSTRACT

A premix burner which comprises a combustion head comprising, in turn, a perforated covering element provided with a plurality of openings. The premix burner is characterised in that it is provided with a device for generating and delivering a minimum granted thermal power completely arranged inside the combustion head. Moreover, the device comprises a concave element, whose concavity faces the internal wall of the perforated covering element.

4 Claims, 2 Drawing Sheets

(56) References Cited

U.S. PATENT DOCUMENTS

| | | | | |
|---|---|---|---|---|
| 6,443,728 | B1 * | 9/2002 | Edberg et al. | 431/266 |
| 6,840,761 | B2 * | 1/2005 | Hong et al. | 431/202 |
| 7,086,855 | B2 * | 8/2006 | Brice et al. | 431/328 |
| 8,814,560 | B2 * | 8/2014 | Le Mer et al. | 431/12 |
| 2002/0132203 | A1 * | 9/2002 | Edberg et al. | 431/265 |
| 2004/0011301 | A1 * | 1/2004 | Gordon et al. | 122/155.1 |
| 2006/0035189 | A1 * | 2/2006 | Berstecher et al. | 431/329 |
| 2006/0048724 | A1 * | 3/2006 | Peart | 122/14.2 |
| 2006/0207524 | A1 | 9/2006 | Peart et al. | |
| 2009/0053664 | A1 * | 2/2009 | Staller et al. | 431/328 |
| 2010/0316965 | A1 * | 12/2010 | Le Mer et al. | 431/12 |

FOREIGN PATENT DOCUMENTS

| | | |
|---|---|---|
| NL | 7412416 | 3/1976 |
| WO | WO 2006/019279 | 2/2006 |
| WO | WO 2009/008588 | 1/2009 |

* cited by examiner

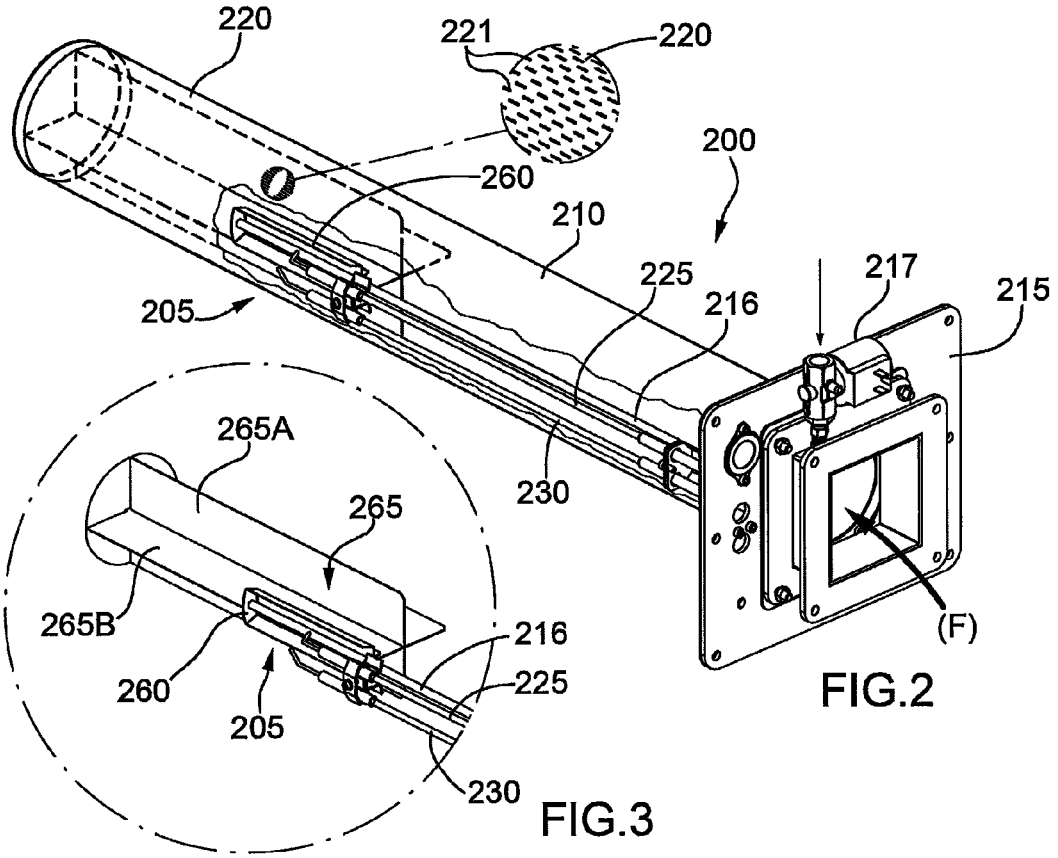
FIG.2
FIG.3
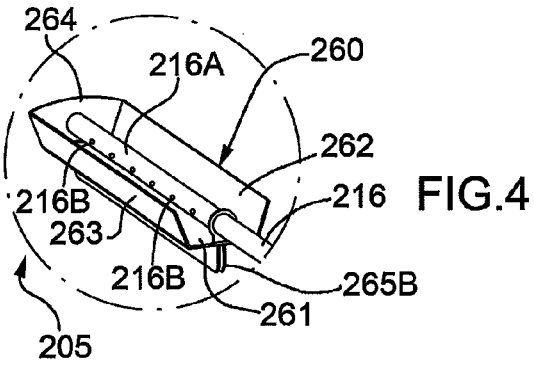
FIG.4
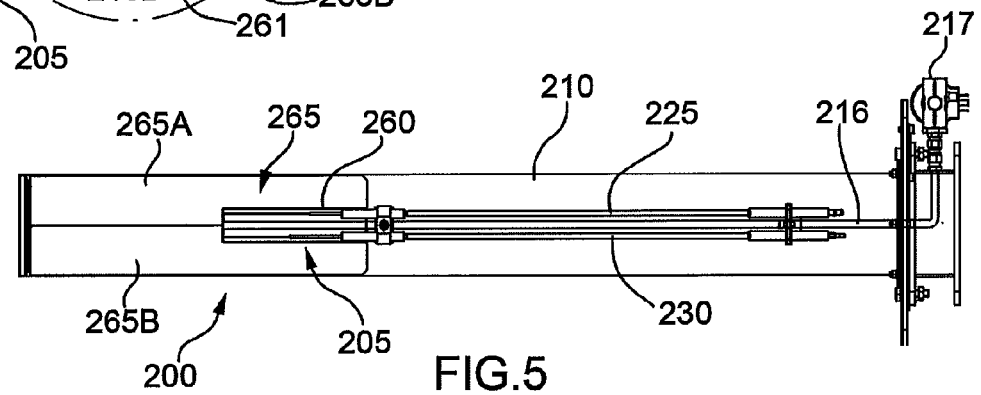
FIG.5

PREMIX BURNER

The present invention relates to a "premix" burner which as known is characterised by a premixing between air and fuel upstream of the combustion zone.

BACKGROUND OF THE INVENTION

In particular, in premix burners the oxidizer air is provided by a fan while the gas flow rate is controlled by a valve.

The combustion zone may take several shapes. In general, the combustion head is provided with a cylindrical body which carries a covering element provided with a plurality of openings.

In particular, the covering element may be a metal fabric.

The mixture is ignited immediately after exiting from the openings of the premixing tube.

To date, most premix burners are characterised by a ratio equal to 5- to 10-fold the maximum power.

However, the spreading of the premix burner technology in increasingly diversified industrial applications, such as for example coating cabins, furnaces, drying plants etc. requires a wide range of the powers deliverable by the same burner. Moreover, in some cases, a considerable reduction of nitrogen oxide emissions is required at the same time.

In premix burners, such reduction is generally obtained by an increase in the air excess with respect to the amount of fuel used. However, such increase makes the lighting of the main flame quite difficult.

For completeness of description, FIG. 1 shows a known premix burner wherein the lighting of the main flame contemplates the use of a device 105 for lighting and maintaining a pilot flame.

The prior art shown in the above FIG. 1 contemplates the use of a premix burner 100 comprising a combustion head 110 and a plate 115 is integral thereto. Such plate 115 is used for attaching the combustion head 110 to the wall of a furnace, or of a drier (not shown).

An air flow is delivered to the combustion head 110 using dedicated fans (not shown), while the gaseous state fuel (combustible gas, or a vaporised liquid fuel) is made to flow towards the combustion head 110 using a duct (not shown).

Moreover, a certain amount of gaseous fuel is delivered to device 105 through a duct 116. The gas flow is regulated by a solenoid valve 117 controlled by electronic means of the known type and not shown. Exiting from duct 116, the combustible gas mixes with the air present in the combustion chamber (CC). Such mixture is lighted by a generating device 125. The pilot flame is then monitored for safety by a probe 130.

In turn, the combustion head 110 comprises a carrying body (not shown in FIG. 1) which supports a perforated covering element 120 provided with a plurality of openings 121.

The combustible/oxidizer mixture that is lighted in the combustion chamber (CC) by the pilot flame generated by the generating device 105 comes out through openings 121.

As shown in an enlargement of FIG. 1, the generating device 105 is attached to the combustion head 110 by means of a bracket 145 and comprises a screening shield 150 substantially perpendicular to the cylindrical wall of the same combustion head 110.

Moreover, for obvious safety reasons, the combustion of the fuel/oxidizer air mixture is externally triggered by the perforated covering element 120.

In order to work properly, an external pilot flame system of the type shown in FIG. 1 requires such pilot flame to be arranged in the vicinity of the combustion zone where it is subject to considerable thermal stresses during the routine operation of the burner. This implies the need of using special materials and screening elements.

Moreover, the delivery tube of the combustion gas to the generating device 105 is external to the combustion head and in general is in an overheated zone and in some cases this makes the use thereof hazardous.

Moreover, in some cases the occupied space required by the dimensions of the generating device 105 makes the use thereof difficult.

SUMMARY OF THE INVENTION

Therefore, the object of the present invention is to provide a premix burner which is free from the above-described drawbacks and at the same time is easy and inexpensive to make.

The present invention may be applied on all types of premix burners where a surface is provided with openings wherefrom the combustion is generated.

The teachings of the present invention may be applied on all premix burners of different shapes, for example flat or cylindrical, where a surface is provided with openings wherefrom the combustion is generated.

Moreover, the openings provided on the combustion zone may be slots or openings or both.

As is known, such types of premix burners may also be characterised by the use of metal or ceramic fabrics arranged on the perforated surface which allow the combustion quality and therefore the operation of the pilot flame to be improved.

According to the present invention, a premix burner is therefore made according to what claimed in claim 1 or in any of the claims either directly or indirectly depending on claim 1.

BRIEF DESCRIPTION OF THE DRAWINGS

A preferred embodiment will now be described for a better understanding of the present invention by way of a non-limiting example only and with reference to the annexed drawings, wherein:

FIG. 2 shows a perspective assembly of a premix burner object of the present invention;

FIG. 3 shows a first group of details of the premix burner shown in FIG. 2;

FIG. 4 shows a second group of enlarged details of the premix burner shown in FIG. 2; and FIG. 5 shows a side view of the premix burner shown in FIG. 2.

DETAILED DESCRIPTION OF THE INVENTION

Figure 1:
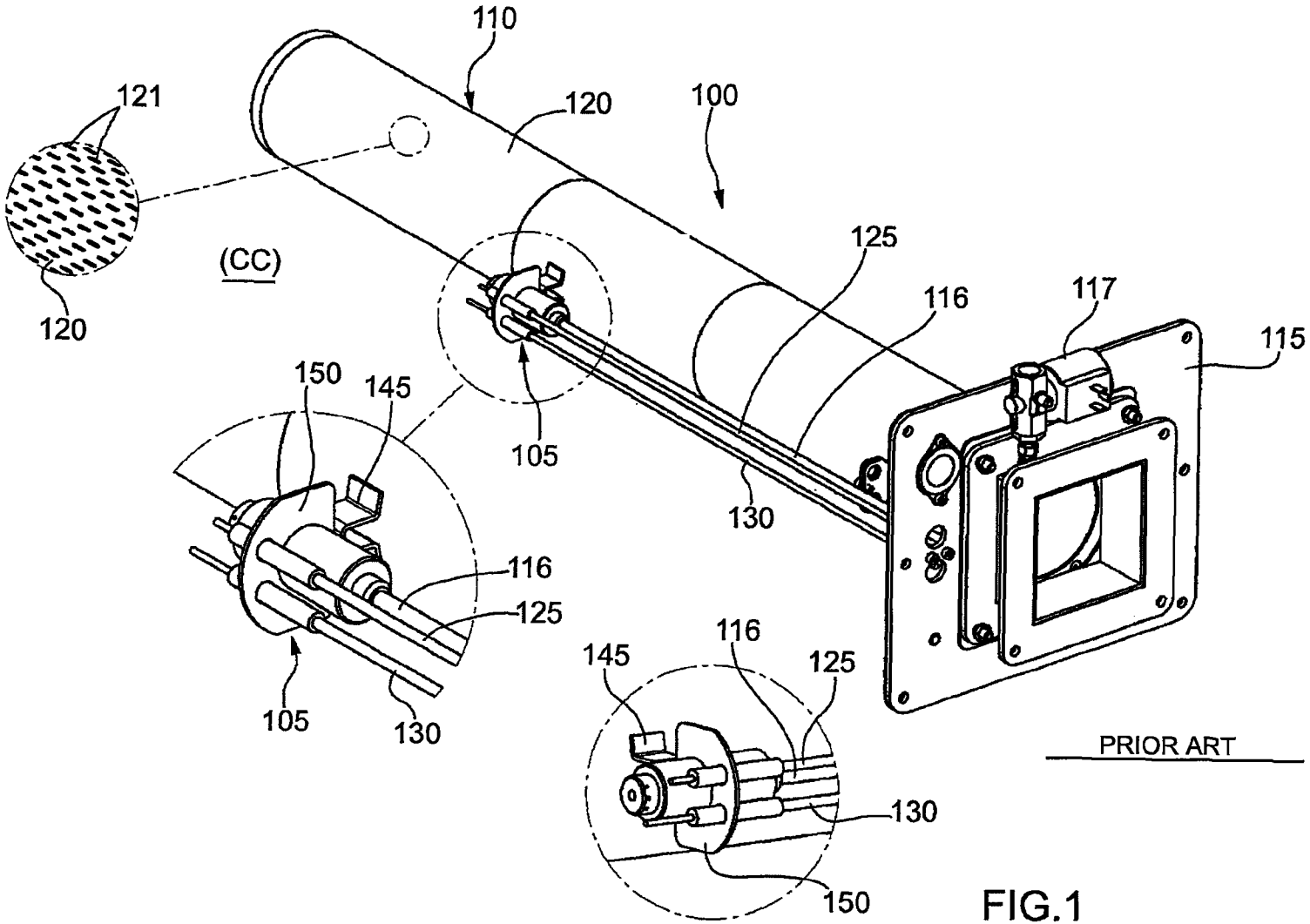
FIG. 1 shows a prior art premix burner.

In FIG. 2, the numbering of elements similar or equal to those of the premix burner belonging to the prior art shown in FIG. 1 has been obtained by adding 100 to the reference numerals used in FIG. 1.

Therefore, in FIG. 2, reference numeral 200 globally indicates a premix burner made according to the teachings of the present invention.

The premix burner 200 object of the present invention comprises a device 205 for generating and maintaining an innovative pilot flame.

As is shown in FIG. 2, such device 205 is completely contained within combustion head 210.

Device 205 comprises a concave element 260, shaped as a roof tile which is closed at one end thereof, whose concavity faces the internal wall of a perforated covering element 220 provided with a plurality of openings 221.

Preferably, but not necessarily, concave element 260 is supported by a support 265, which may be obtained by two sheets 265A, 265B fixed to each other so as to form a cross (FIG. 3), or by means of any other type of support element (not shown) such as to ensure the correct positioning of the same concave element 260. Support 265 is then covered by the perforated covering element 220.

As shown in greater detail in FIGS. 3, 4, 5, concave element 260 is advantageously made of a single metal sheet, which has been bent so as to form a bottom 261, two lateral walls 261, 263 and an end wall 264.

The distal end 216A of duct 216, a spark electrode 225 and a probe 230 are arranged in the inside of concave element 260 (FIG. 3).

As shown in particular in FIG. 4, a series of openings 216B has been made on distal end 216A of duct 216 which allows the escape of the combustible gas substantially inside the concave element 260. Such openings 216B may be in different shape and number and arranged in various manners on distal end 216A.

Oxidizer air only may be delivered from the inlet of cylindrical combustion head 210 (arrow (F); FIG. 2) which also partially enters concave element 260. A mixture is generated inside concave element 260 only which consists of a portion of the air entering combustion head 210 according to arrow (F) and of the combustible gas that comes out of openings 216B.

The combustion of the mixture thus formed is triggered by electrode 225 and monitored by probe 230 (FIG. 3).

The operation of the flame of device 205 is managed by means of solenoid valve 217.

The flame that is generated in device 205 may work for an extended time or it may be used for igniting the whole premix burner 200.

In the first case, a considerable increase occurs in the power field delivered, in the second case such flame is considered a pilot flame.

In brief, three scenarios are possible:

(1) device 205 is ignited and remains ignited, delivering a minimum granted thermal power; or (2) device 205 is ignited and only serves for lighting the main flame of a combustible gas/oxidizer gas that enters head 210 according to arrow (F) and comes out of openings 221; after the lighting of the main flame, device 205 is switched off; in this case, an intermediate thermal power is delivered; or (3) both device 205 and the main flame remain on; in this case, the thermal power is the maximum one that can be delivered by the system.

The main advantage of the premix burner object of the present invention consists in that an easy to light and low power initial pilot flame is obtained, which triggers the main flame of the burner. However, such pilot flame has such a power as to be optionally able to deliver an appreciable thermal power by itself.

Moreover, since all the elements that belong to the generating device are contained within the combustion head, the explosion hazards incidental to exposing ducts that carry flammable gas directly at the heat of the combustion chamber are prevented.

The invention claimed is:

1. A premix burner comprising:

a combustion head comprising, in turn, a perforated covering element provided with a plurality of openings;

means for fixing said combustion head to a wall of a combustion chamber (CC);

means for feeding an oxidizer gas to the combustion head;

means for feeding a combustible gas to the combustion head;

a premix burner characterised in that it comprises a device for generating and delivering a minimum granted thermal power, said device being completely arranged inside said combustion head;

and in that said device comprises a concave element, whose concavity faces the internal wall of said perforated covering element, wherein the concave element is supported by a support and said support comprises two flat elements, which are fixed to each other so as to form a cross.

2. A premix burner, according to claim 1, wherein said concave element has the shape of a roof tile, which is closed on one end.

3. A premix burner, according to claim 2, wherein said concave element is advantageously made of a single metal sheet, which has been bent so as to form a bottom, two lateral walls and an end wall.

4. A premix burner, according to claim 1, wherein the inside of said concave element there are arranged the distal end of a gas delivery duct, which is provided with a plurality of openings, a spark electrode and a probe.

* * * * *